US006135863A

United States Patent [19]

Zhang et al.

[11] Patent Number: 6,135,863

[45] Date of Patent: Oct. 24, 2000

[54] METHOD OF CONDITIONING WAFER POLISHING PADS

[75] Inventors: David Zhang, Ballwin; Ralph V. Vogelgesang, Old Monroe; Henry F. Erk, St. Louis, all of Mo.

[73] Assignee: MEMC Electronic Materials, Inc., St. Peters, Mo.

[21] Appl. No.: 09/295,127

[22] Filed: Apr. 20, 1999

[51] Int. Cl.[7] ..... B24B 1/00; B24B 7/00

[52] U.S. Cl. ..... 451/56; 451/41; 451/59; 451/72; 451/443

[58] Field of Search ..... 451/36, 41, 59, 451/60, 63, 72, 264, 56, 268, 269, 287, 288, 290, 443

[56] References Cited

U.S. PATENT DOCUMENTS

| | | | |
|---|---|---|---|
| 5,245,790 | 9/1993 | Jerbic . | |
| 5,329,734 | 7/1994 | Yu . | |
| 5,422,316 | 6/1995 | Desai et al. . | |
| 5,527,424 | 6/1996 | Mullins . | |
| 5,672,095 | 9/1997 | Morimoto et al. | 451/41 |
| 5,746,771 | 5/1998 | Isobe | 451/41 |
| 5,797,789 | 8/1998 | Tanaka et al. | 451/289 |
| 5,827,395 | 10/1998 | Masumura et al. . | |
| 5,840,202 | 11/1998 | Walsh . | |
| 5,890,951 | 4/1999 | Vu | 451/56 |
| 5,944,590 | 8/1999 | Isobe et al. | 451/288 |
| 6,007,411 | 12/1999 | Feeney | 451/285 |

*Primary Examiner*—Timothy V. Eley
*Attorney, Agent, or Firm*—Senniger, Powers, Leavitt & Roedel

[57] ABSTRACT

A method of conditioning a polishing pad for use with a polishing machine. The method includes installing the polishing pad to be conditioned on the polishing machine's platen and applying a conditioning load force to the pad. In addition, the method includes supplying a slurry to the pad at a conditioning flow rate. The conditioning load force is greater than a polishing load force applied during a conventional wafer polishing cycle to compress the pad and the conditioning flow rate is greater than a polishing flow rate at which the slurry is supplied during the wafer polishing cycle to load the pad's pores with abrasive material. The method also includes the step of operating the polishing machine for a conditioning cycle while applying the conditioning load force and supplying the slurry at the conditioning flow rate. In this manner, the polishing pad is conditioned for use with the polishing machine for subsequently polishing the semiconductor wafers with the conditioned pad.

20 Claims, 4 Drawing Sheets

METHOD OF CONDITIONING WAFER POLISHING PADS

BACKGROUND OF THE INVENTION

This invention relates generally to wafer polishing and, particularly, to a method of conditioning a pad for use in polishing semiconductor wafers with a double side or single side polishing machine.

Most processes for fabricating semiconductor electronic components start with monocrystalline, or single crystal, semiconductor material in the form of wafers. Semiconductor wafers are produced by thinly slicing a single crystal ingot into individual wafers with a cutting apparatus, such as a wire saw or inner diameter saw. The as-cut wafers undergo a number of processing operations to shape them, reduce their thicknesses and remove damage caused by the slicing operation. In addition, the wafers undergo chemical-mechanical polishing to planarize their surfaces. This polishing technique involves rubbing each wafer with a polishing pad in a solution that contains an abrasive and chemicals to produce an extremely flat, highly reflective and damage-free wafer surface. One such polishing solution, or slurry, includes a colloidal silica and an alkaline etchant. The polishing pad is, for example, a polyurethane impregnated polyester felt having a thickness between about 1.5 mm and 2.0 mm.

In determining the quality of a processed semiconductor wafer, the flatness of the wafer is a critical parameter to customers since it has a direct impact on the subsequent use and quality of semiconductor chips diced from the wafer. A number of parameters determine the wafer flatness, including a GBIR (Global Backside Indicated Reading) measurement. The GBIR measurement represents the difference between the highest point on a top surface of the wafer with respect to a reference plane parallel to the back side of the wafer. In this instance, the wafer is mounted on a vacuum chuck that translates any surface variations on the back side of the wafer to the front side of the wafer for measurement. ADE Corporation of Westwood, Mass. sells non-contacting electric-capacity type sensors for characterizing wafer geometry and measuring flatness under the trademarks UltraGage® 9500 and Galaxy AFS-300™.

To maximize throughput in the preparation of semiconductor wafers, a polishing machine polishes many wafers simultaneously. Such a machine typically holds 5 to 30 wafers, depending on their size, in carriers. The machine moves the carriers relative to a rotating circular turntable, or platen, for polishing. The platen is typically cast iron and overlaid with a polishing pad. The machine dispenses a stream of polishing slurry to a surface of the pad while the pad is pressed against the wafers. Single-side polishing machines have one platen for polishing a surface of the wafers, while double-side polishing machines have two platens for polishing the top and bottom surfaces of the wafers simultaneously. Both the platen and polishing pad must be extremely flat to ensure that polished wafers are likewise extremely flat. During polishing, the wafer carriers and platen usually rotate in opposite directions for a predetermined time, a typical duration being about 30 to 80 minutes.

Unfortunately, conventional polishing machines usually produce highly concave (dished shape) wafers the polishing pads are new. These wafers typically have an unacceptable global flatness, GBIR, of approximately 1.5 $\mu$m or more. One procedure for preventing unduly concave wafers after new polishing pads have been installed on a polishing machine is to condition the pads by performing 10 to 20 dummy runs before actual polishing runs begin. In a dummy run, which takes about one hour per run, the new pads are used to polish dummy wafers (e.g., wafers rejected for various reasons). Under the conventional conditioning procedure, approximately 10 to 20 hours of dummy runs are needed to condition the newly installed polishing pads before relatively flat wafers can be produced by the polishing machine. For this reason, a method is desired for economically and quickly conditioning new polishing pads without numerous, expensive and time-consuming dummy runs.

SUMMARY OF THE INVENTION

The invention meets the above needs and overcomes the deficiencies of the prior art by providing a method of breaking in new polishing pads for use with a polishing machine. Among the several objects and features of the present invention may be noted the provision of such a method that permits the polishing pads to be used for polishing wafers in less time; the provision of such method that does not shorten the expected life of the pads; the provision of such method that may be performed on existing equipment; and the provision of such a method that is economically feasible and commercially practical.

Briefly described, a method embodying aspects of the invention is for conditioning a polishing pad for use with a polishing machine. The machine has a platen adapted to receive the pad and is operable for a wafer polishing cycle to polish semiconductor wafers with the pad. The method includes the step of installing the polishing pad to be conditioned on the platen of the machine. The method also includes applying a conditioning load force to a polishing surface defined by the pad and supplying a slurry containing abrasive particles to the polishing surface at a conditioning flow rate. The conditioning load force is greater than a polishing load force applied to the polishing surface during the wafer polishing cycle and the conditioning flow rate is greater than a polishing flow rate at which the slurry is supplied to the polishing surface during the wafer polishing cycle. The method further includes the step of operating the polishing machine for a conditioning cycle while applying the conditioning load force and supplying the slurry to the polishing surface. In this manner, the polishing pad is conditioned for use with the machine for subsequently polishing the semiconductor wafers with the conditioned polishing pad.

Another embodiment of the invention is directed to a method for conditioning a polishing pad for use with a polishing machine. The machine has a platen adapted to receive the pad and is operable for a wafer polishing cycle to polish semiconductor wafers with the pad. The polishing pad defines a polishing surface. The method includes the step of installing the polishing pad to be conditioned on the platen of the machine. The method also includes compressing the pad at a pressure greater than a polishing pressure applied to the polishing surface during the wafer polishing cycle and loading pores of the pad with abrasive particles from a slurry. The pores of the pad are loaded by supplying the slurry to the polishing surface at a flow rate greater than a polishing flow rate at which the slurry is supplied to the polishing surface during the wafer polishing cycle. The method further includes the step of operating the polishing machine for a conditioning cycle while compressing the polishing pad and loading the pores. In this manner, the polishing pad is conditioned for use with the polishing machine for subsequently polishing the semiconductor wafers with the conditioned polishing pad.

Alternatively, the invention may comprise various other methods and systems.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF PREFERRED EMBODIMENTS

Figure 1:
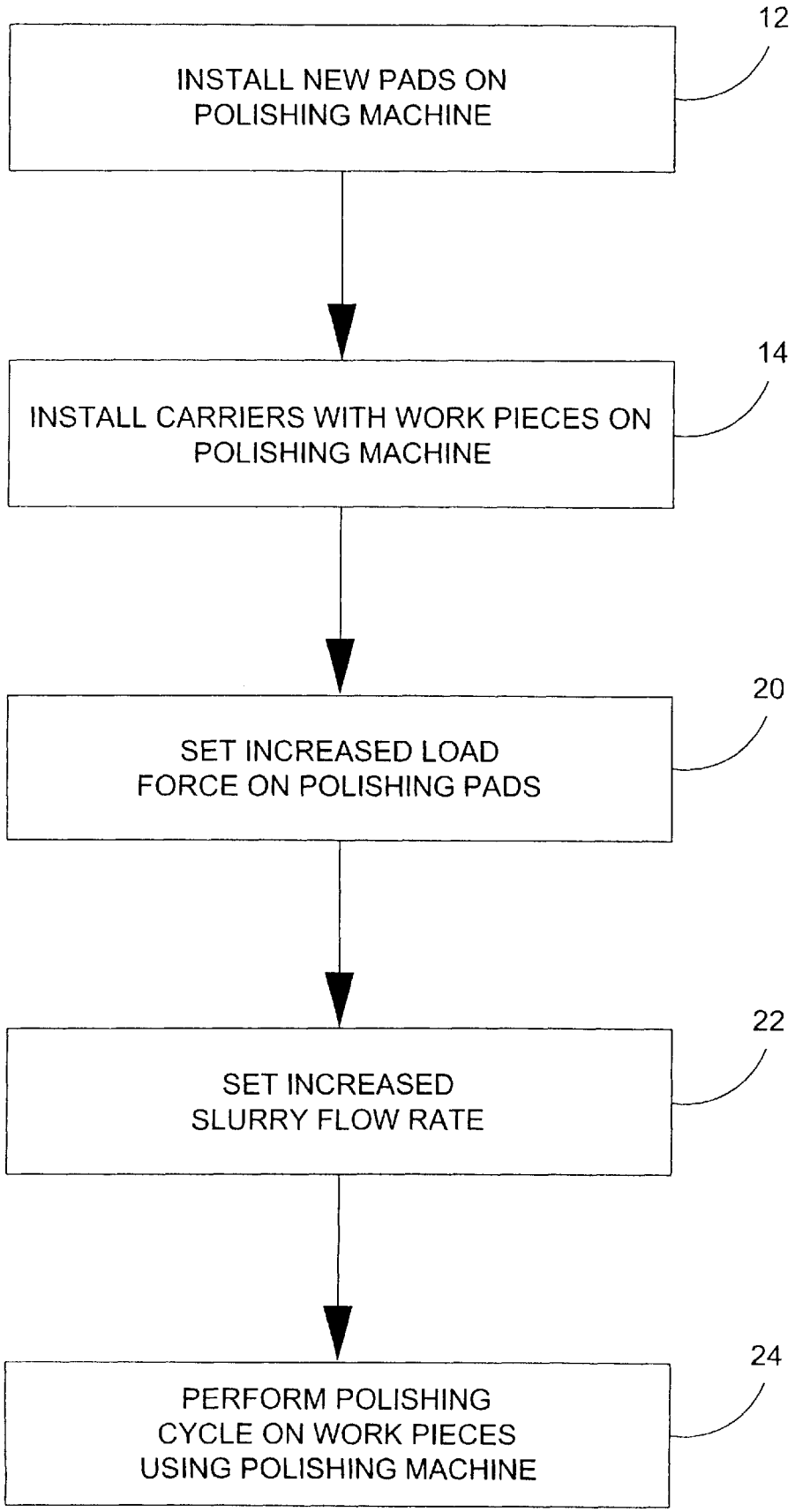
FIG. 1 is a flow diagram illustrating a method of conditioning polishing pads according to a preferred embodiment of the invention.
Figure 2:
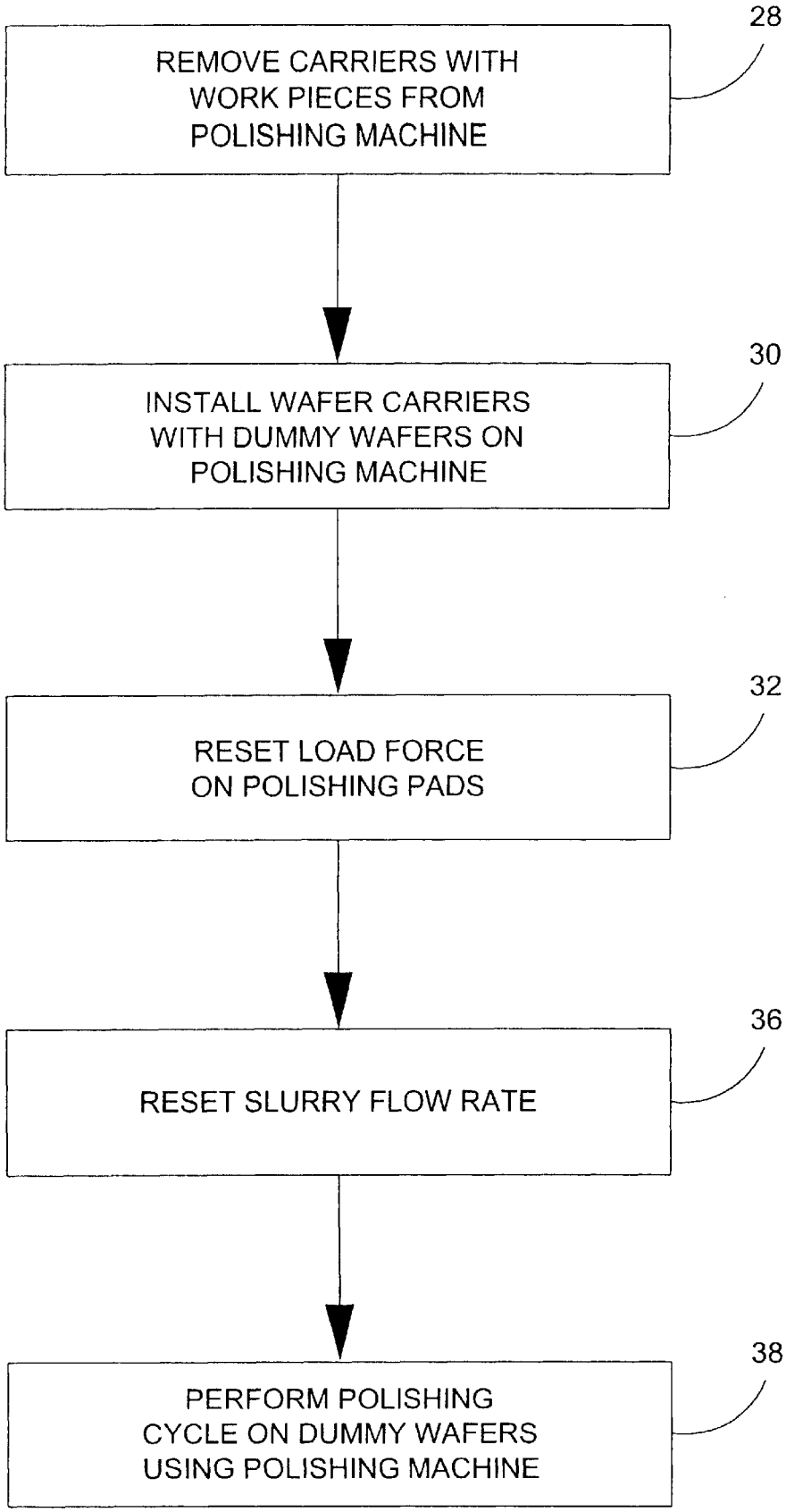
FIG. 2 is a flow diagram illustrating additional steps to the method of FIG. 1.

Referring now to the drawings, FIGS. 1 and 2 illustrate a preferred method embodying aspects of the present invention in flow diagram form. The present method advantageously conditions new polishing pads (not shown) for use with a wafer polishing machine (not shown). As described above, conventional polishing machines usually produce highly concave (i.e., dished shape) wafers when installed with new polishing pads. Rather than conditioning the new pads by performing multiple polishing runs on dummy wafers, the method of the present invention provides an economical and quick program for conditioning the pads without numerous, expensive and time-consuming dummy runs.

Peter Wolters AG of Rendsburg, Germany manufactures conventional double-side polishers under the model designations AC 2000 and AC 1400 suitable for use with the present invention. Construction and operation of a conventional double-side polishing machine for polishing semiconductor wafers is well known to those skilled in the art and will not be described herein except to the extent necessary to describe the method of the present invention. Although described herein with reference to a double-side polishing machine, it is to be understood that the method of FIGS. 1 and 2 may be performed with a conventional single-side polisher instead of a double-side polisher.

The double-side polishing machine polishes the front and back surfaces of several wafers concurrently to remove damage caused by prior processing operations and to provide a mirror finish. For example, the double-side polishing operation usually removes between 24 $\mu$m and 30 $\mu$m (12–15 $\mu$m per side) of thickness from each wafer. The machine has a rotatable lower platen with a polishing surface defined by a polishing pad and is adapted to receive one or more wafer carriers seated on the polishing pad. Preferably, the wafer carriers are rotatable relative to the lower platen and polishing pad and each holds one or more wafers with the front wafer surfaces engaging the polishing pad. An upper platen supports a second polishing pad facing opposite the front surfaces of the wafers. The upper platen is attached to a motor-driven spindle that rotates the upper platen and second polishing pad relative to the lower platen and wafer carriers. The spindle also provides movement in a vertical direction. By moving the upper platen up and down, the spindle moves the second polishing pad out of and into polishing engagement with the back surfaces of the wafers. This effectively "sandwiches" the wafers between the two polishing pads. The force exerted against the wafers by the polishing pads, otherwise referred to as the polishing pressure, is generally a function of the downward force exerted by the vertically movable upper platen and polishing pad.

During the double-side polishing operation, the machine applies a polishing slurry containing abrasive particles and a chemical etchant between the polishing pads and the wafers. As an example, the polishing slurry is a colloidal silica and an alkaline etchant. The polishing pads work the slurry against the surfaces of the wafer to concurrently and uniformly remove material from the front and back wafer surfaces. This removes much of the damage caused by lapping and etching operations, substantially improves the flatness of the wafers and produces polished front and back surfaces.

Machines of this type usually have several programmable operating parameters such as polishing pressure, upper platen speed, lower platen speed, inner drive ring speed, outer drive ring speed, etchant flow rate, slurry flow rate and the temperature of cooling water used for cooling the platens.

In a preferred embodiment, the lower platen holds a regular polyurethane impregnated polyester felt polishing pad and the upper platen holds an embossed polyurethane impregnated polyester felt polishing pad. The embossed pad used on the upper platen helps retain the wafers on the lower platen after the completion of each cycle run.

Preferably, the method of FIG. 1 establishes a recipe, or program, for conditioning new polishing pads for use with a double-side or single-side polishing machine. An operator begins at step 12 by installing new polishing pads on the polishing machine in a conventional manner. At step 14, the operator then installs carriers 16 (see FIGS. 3 and 4) on the polishing machine. In this instance, the carriers 16 are loaded with work pieces (not shown) rather than with wafers for use in the conditioning, or breaking in, process. The work pieces are flat disks of rigid material, such as silicon carbide and/or ceramic, and able to withstand relatively high load forces. Also, the front and back surfaces of the work piece are highly finished to prevent damage to the polishing pads. Proceeding to steps 20 and 22, the operator increases the load force, or polishing pressure, and the slurry flow rate relative to the normal settings for polishing wafers. Advantageously, high polishing pressure in combination with high slurry flow of an alkaline-based silica solution, for example, rapidly conditions the new pads on both upper and lower platens during a polishing cycle performed at step 24. The high pressure and high alkaline-based silica flow act together to highly compress the pads against the work pieces and carriers 16 and load silica from the slurry into their pores.

Table I, below, Table I provides exemplary ranges for the polishing machine's operating parameters, namely polishing pressure and slurry flow rate, according to a preferred embodiment of the invention. Table I also compares the ranges used for conditioning to the conventional ranges for wafer polishing.

TABLE I

| Name of Program | Load Force on Polishing Pads (daN) | Alkaline-based Silica Flow Rate (ml/min) | Cycle Time (min) |
|---|---|---|---|
| Wafer Polishing | 200–700 | 40–120 | 30–80 |
| Pad Break-In | 1000–3000 | 120–360 | 10–50 |

Operating the polishing machine at a polishing pressure between about 1000 daN and 3000 daN and with a slurry flow rate between about 120 ml/min and 360 ml/min provides faster compression and silica loading of the polishing pad. In addition, applying relatively high pressure to the pad essentially hardens and flattens it. This improves global flatness characteristics of wafers polished by the pads because the conditioned pads have a more uniform global surface. Also, harder pads are better able to remove long wavelength surface defects than softer pads. In general, the double side polishing process can produce super flat wafers with the conditioned pads immediately after completion of the polishing pad break-in routine of FIG. 1. This significantly reduces the conditioning time to a relatively short period of time (i.e., less than 1 hour) from the 20 hours or more required by conventional conditioning techniques. Since the present invention eliminates the need for multiple dummy runs to condition new polishing pads, rapid turnaround from new pad installation to production can be achieved. Moreover, by eliminating the need for multiple dummy runs, the life span of the polishing pads is extended.

FIG. 2 illustrates method steps for providing a check on the pad conditioning routine of FIG. 1 to ensure that the pads will produce wafers having an acceptable flatness. At step 28, the operator removes carriers 16 and the work pieces from the polishing machine and, at step 30, replaces them with regular wafer carriers loaded with dummy wafers. Proceeding to steps 32 and 36, the operator decreases the polishing pressure and slurry flow rate to reset the operating parameters for normal wafer polishing. A polishing cycle performed on the dummy wafers at step 38 produces wafers that can be measured for flatness to ensure that the new polishing pads have been properly conditioned.

Figure 3:
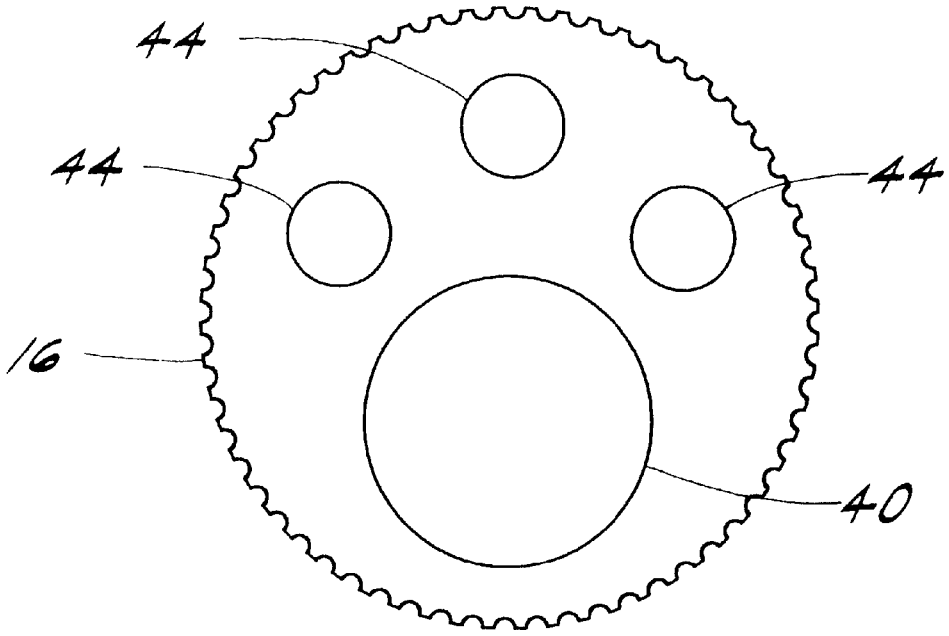
FIG. 3 is a top view of a work piece carrier for use with the method of FIG. 1.
Figure 4:
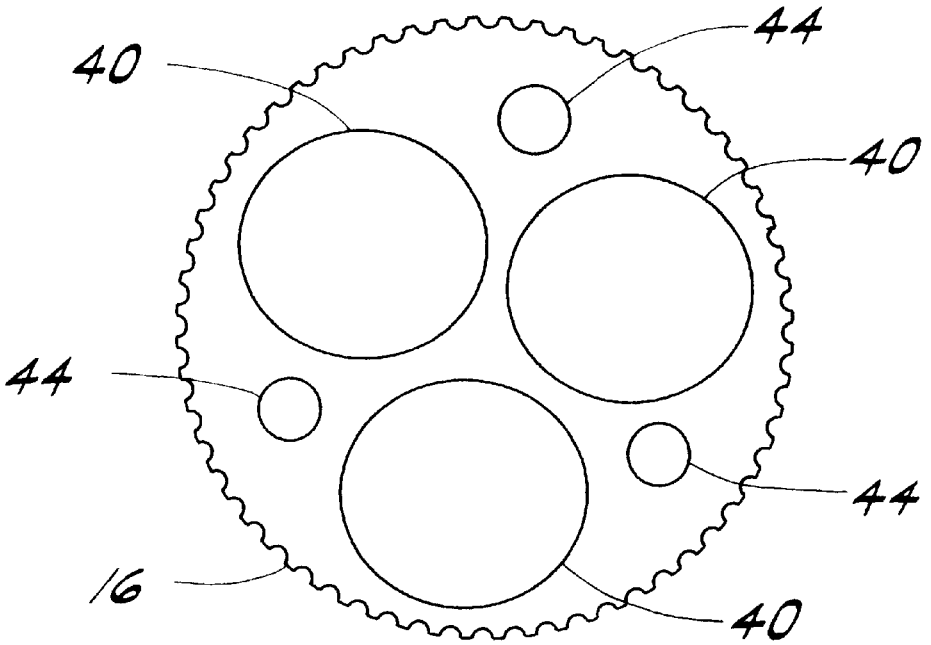
FIG. 4 is a top view of another work piece carrier for use with the method of FIG. 1.

Referring now to FIGS. 3 and 4, one preferred embodiment of the invention employs carriers 16 for holding the work pieces during the break-in process. Carriers 16 are adapted for use with conventional polishing machines and, thus, have outer dimensional characteristics similar to those of regular wafer carriers. In contrast, however, carriers 16 are particularly well-suited to sustain the high pressure and shearing forces associated with the break-in process that would otherwise likely damage the wafer carriers. As an example, carriers 16 are each about 15 mm to 25 mm thick, generally circular and made from a high performance plastic, such as the materials sold under the trademarks DELRIN®, PEEK™ and TECHRON PPS™. The thickness of the carriers 16 is slightly less than (by approximately 1000 $\mu$m to 2000 $\mu$m) the thickness of the work pieces. As a result, the surface of each work piece, which has a highly polished finish, is used for conditioning the pads rather than the surface of the carriers 16. Also, the pressure from the polishing machine is largely on the work pieces so that the carriers 16 are easily moved even when the polishing machine is applying a high pressure. Carriers 16 have smooth, polished front and back surfaces but not as highly polished as the work pieces.

Preferably, carriers 16 have one to three openings 40 for holding the work pieces and one to three openings 44 for slurry. FIG. 3 illustrates carrier 16 suitable for use with the Peter Wolters AC 1400 polishing machine with one work piece opening 40 and three slurry openings 44 and FIG. 4 illustrates carrier 16 suitable for use with the Peter Wolters AC 2000 polishing machine with three work piece openings 40 and three slurry openings 44. For example, the carrier 16 of FIG. 3 is approximately 546 mm in diameter and the work piece opening 40 is approximately 229 mm in diameter and the carrier 16 of FIG. 4 is approximately 724 mm in diameter and the work piece openings 40 are each approximately 229 mm in diameter. Since openings 40, 44 are generally circular in shape, carriers 16 are less likely to be damaged under the high load forces of the break-in process than if they were, for example, angular in shape. Further, the slurry openings 44 are sized (e.g., 80 mm in diameter) to accommodate the increased slurry flow rate.

Figure 5:
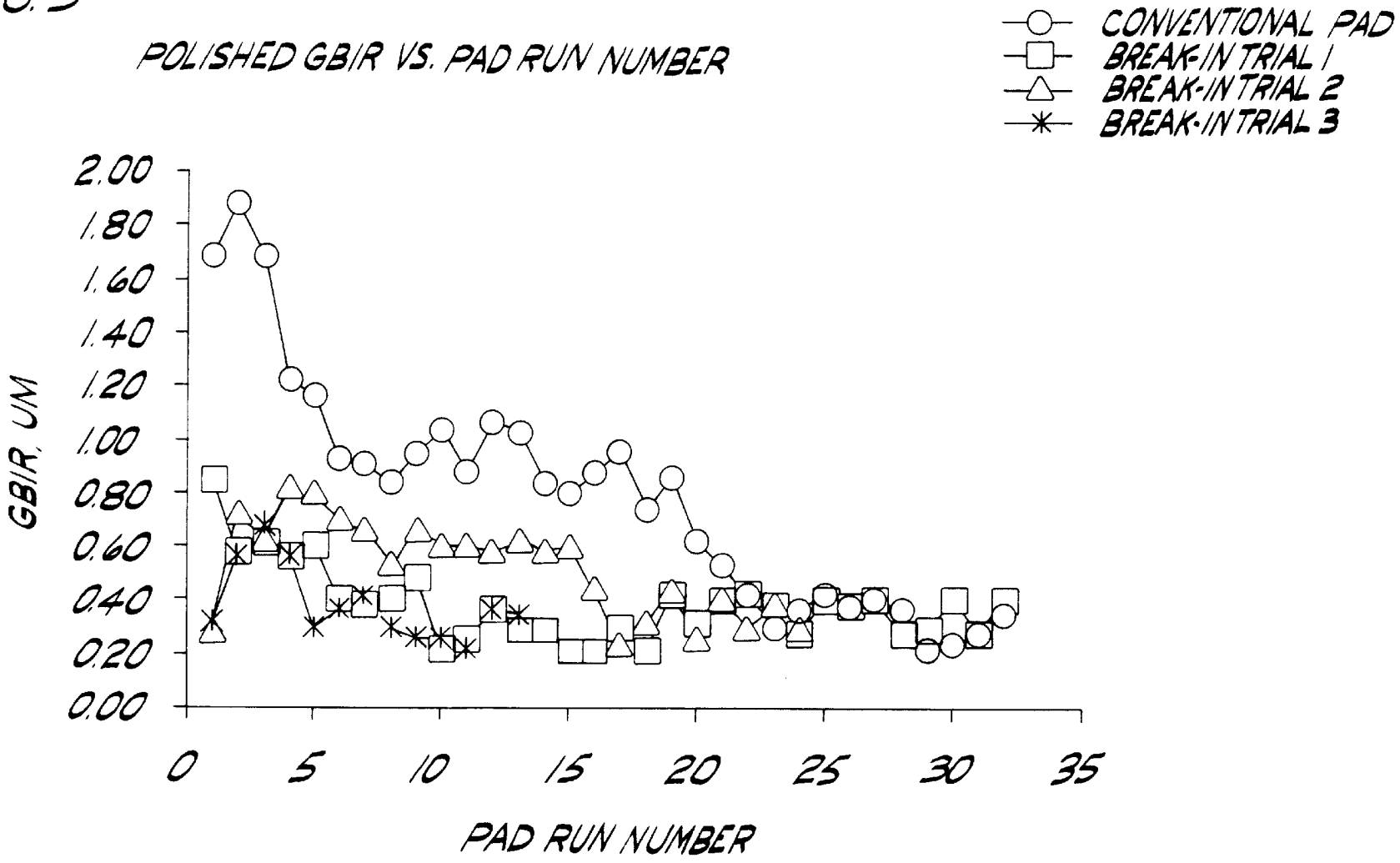
FIG. 5 is a graph of exemplary wafer flatness data comparing wafers polished with pads conditioned according to the method of FIG. 1 to wafers polished with pads conditioned by a prior art method.

FIG. 5 provides a graph of exemplary flatness data for single crystal silicon wafers polished in accordance with conventional polishing techniques as compared to single crystal silicon wafers polished after conditioning the polishing pads in accordance with the method of FIGS. 1 and 2. The graph indicates that pads conditioned according to the present invention produce flatter wafers more quickly (i.e., after fewer runs) than other pads. In addition, the conditioned pads are better able to eliminate grinding marks than conventional pads. For example, when grinding is used before polishing, Hologenix pictures reveal grinding marks visible on the surfaces of the polished wafers. These marks are visible even after the wafers are polished with pads that have been used on several polishing runs. In contrast, pads conditioned according to the invention remove visible grinding marks as early as the first polishing run following the conditioning routine.

While the method of the present invention is illustrated and described herein with reference to semiconductor wafers constructed of silicon, it is understood that the method is applicable to processed wafers, discs or the like constructed of other materials without departing from the scope of this invention.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of conditioning a polishing pad for use with a polishing machine, said polishing pad defining a polishing surface, said polishing machine having a platen adapted to receive the polishing pad and being operable for a wafer polishing cycle to polish semiconductor wafers with the polishing pad, said polishing machine applying a polishing load force to the polishing surface during the wafer polishing cycle, said polishing machine further supplying a slurry containing abrasive particles to the polishing surface at a polishing flow rate during the wafer polishing cycle, said method comprising the steps of:

installing the polishing pad to be conditioned on the platen of the polishing machine;

applying a conditioning load force to the polishing surface, said conditioning load force being greater than the polishing load force applied to the polishing surface during the wafer polishing cycle of the polishing machine;

supplying the slurry containing abrasive particles to the polishing surface at a conditioning flow rate, said conditioning flow rate being greater than the polishing flow rate at which the slurry is supplied to the polishing surface during the wafer polishing cycle of the polishing machine; and operating the polishing machine for a conditioning cycle while applying the conditioning load force and supplying the slurry to the polishing surface at the conditioning flow rate thereby to condition the polishing pad for use with the polishing machine for subsequently polishing the semiconductor wafers with the conditioned polishing pad.

2. The method of claim 1 wherein the conditioning load force is greater than approximately 1000 daN.

3. The method of claim 1 wherein the conditioning load force is between about 1000 daN and 3000 daN.

4. The method of claim 1 wherein the polishing machine is adapted to receive a carrier, said carrier holding a work piece for polishing engagement by the polishing pad, and further comprising the step of installing the carrier with the work piece on the polishing machine.

5. The method of claim 4 wherein the step of applying the conditioning load force to the polishing surface includes applying the conditioning load force to the polishing pad and the work piece with the polishing machine.

6. The method of claim 4 wherein the work piece is adapted to withstand pressures greater than approximately 1000 daN.

7. The method of claim 4 wherein the thickness of the work piece is greater than the thickness of the work piece carrier.

8. The method of claim 4 wherein the thickness of the work piece is about 1000 $\mu$m to about 2000 $\mu$m greater than the thickness of the work piece carrier.

9. The method of claim 4 wherein the work piece is a silicon carbide material.

10. The method of claim 4 wherein the work piece is a ceramic material.

11. The method of claim 4 wherein the step of supplying the slurry to the polishing surface includes supplying the slurry between the polishing pad and the work piece.

12. The method of claim 4 wherein the carrier is a generally circular disk having at least one opening adapted to receive the work piece and at least one opening for providing a slurry inlet.

13. The method of claim 12 wherein the opening for the work piece is substantially larger than the slurry inlet.

14. The method of claim 12 wherein the carrier is approximately 15 to 25 mm thick.

15. The method of claim 1 wherein the abrasive particles contained in the slurry are sized in the range of about 100 nm to about 200 nm.

16. The method of claim 1 wherein the conditioning flow rate is greater than about 120 ml/min.

17. The method of claim 1 wherein the conditioning flow rate is between about 120 ml/min. and about 360 ml/min.

18. The method of claim 1 wherein the conditioning cycle is shorter in duration than the wafer polishing cycle.

19. The method of claim 1 wherein the conditioning cycle is less than about 50 minutes.

20. A method of conditioning a polishing pad for use with a polishing machine, said polishing pad defining a polishing surface, said polishing machine having a platen adapted to receive the polishing pad and being operable for a wafer polishing cycle to polish semiconductor wafers with the polishing pad, said polishing machine applying a polishing pressure to the polishing surface during the wafer polishing cycle, said polishing machine further supplying a slurry containing abrasive particles to the polishing surface at a polishing flow rate during the wafer polishing cycle, said method comprising the steps of:

installing the polishing pad to be conditioned on the platen of the polishing machine;

compressing the polishing pad at a pressure greater than the polishing pressure applied to the polishing surface during the wafer polishing cycle of the polishing machine;

loading pores of the polishing pad with abrasive particles from a slurry containing the abrasive particles by supplying the slurry to the polishing surface at a flow rate greater than the polishing flow rate at which the slurry is supplied to the polishing surface during the wafer polishing cycle of the polishing machine; and operating the polishing machine for a conditioning cycle while compressing the polishing pad and loading the pores thereby to condition the polishing pad for use with the polishing machine for subsequently polishing the semiconductor wafers with the conditioned polishing pad.

* * * * *